US005470070A

United States Patent [19]

Bendo

[11] Patent Number: 5,470,070

[45] Date of Patent: Nov. 28, 1995

[54] T-SHAPED GOLF PUTTER

[76] Inventor: Christopher J. Bendo, 12203 Roxbury, Tecumseh, Ontario, Canada, N8N 4M8

[21] Appl. No.: 334,133

[22] Filed: Nov. 4, 1994

[51] Int. Cl.[6] ..... A63B 53/04

[52] U.S. Cl. ..... 273/167 R; 273/169; 273/167 F; 273/167 D

[58] Field of Search ..... 273/77 A, 167 R, 273/168, 169, 175, 167 C, 167 D, 167 F, 167 G

[56] References Cited

U.S. PATENT DOCUMENTS

| | | | |
|---|---|---|---|
| D. 196,736 | 10/1963 | Carlo | 273/167 D |
| 3,758,115 | 9/1973 | Hoglund | 273/167 A |
| 4,138,117 | 2/1979 | Dalton | 273/167 F |
| 4,964,639 | 10/1990 | Tucker | 273/169 |
| 5,080,365 | 1/1992 | Winchell | 273/167 C |

*Primary Examiner*—V. Millin

*Assistant Examiner*—William M. Pierce

*Attorney, Agent, or Firm*—Harness, Dickey & Pierce

[57] ABSTRACT

A golf club of the putter type is formed with a horizontally arranged T-shaped head having an elongated stem and laterally extending arms which terminate in integral enlargements that form weights. The stem and arms of the T-shape have a forward, normally vertically arranged surface which provide a ball impacting surface on the head. The head has a center of mass located a short distance rearwardly of the impacting surface and along the longitudinal, horizontally arranged axis of the stem. A shaft is connected to the head between the center of mass and the impacting surface. The shaft has a short lower portion which is bent forwardly and sidewise relative to the head. Also, the shaft has an upper portion, which is integral with the lower portion that is bent at an acute angle relative to the vertical axis of the head. Markings may be formed on the upper surface of the head for providing sight lines for aiming the stem along a desired direction.

7 Claims, 3 Drawing Sheets

FIG - 4
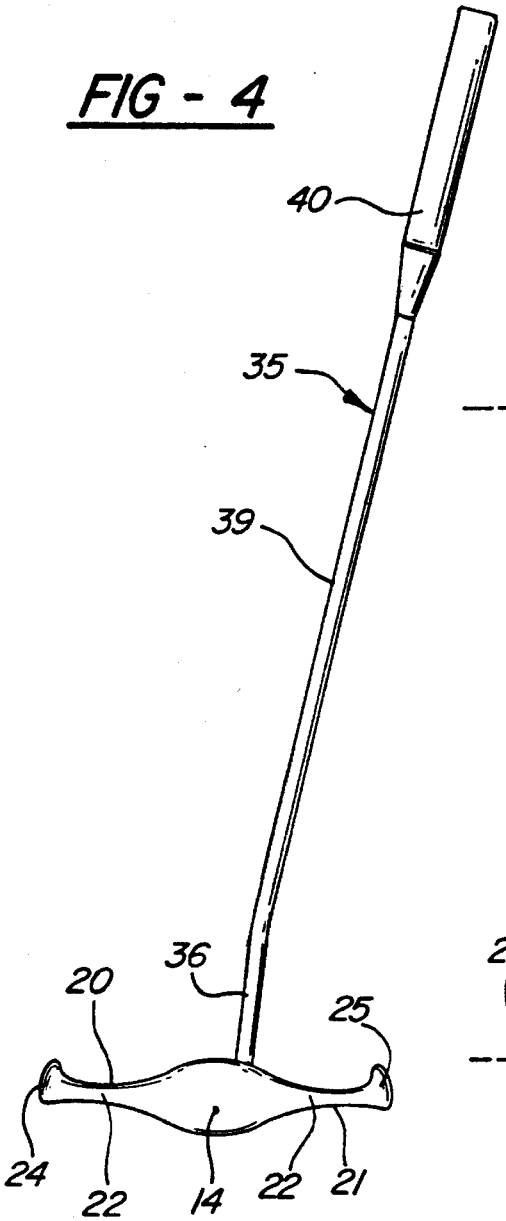
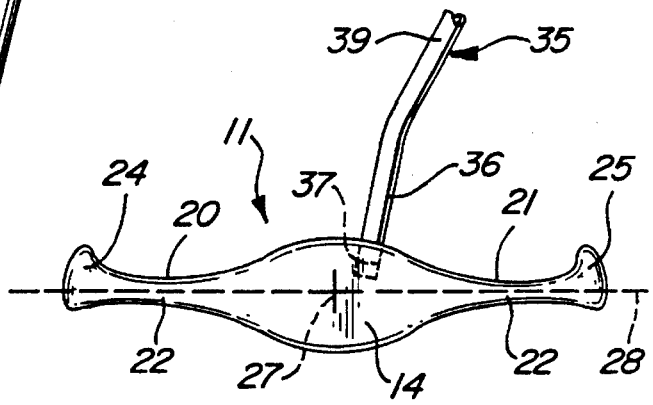
FIG - 5
FIG - 6
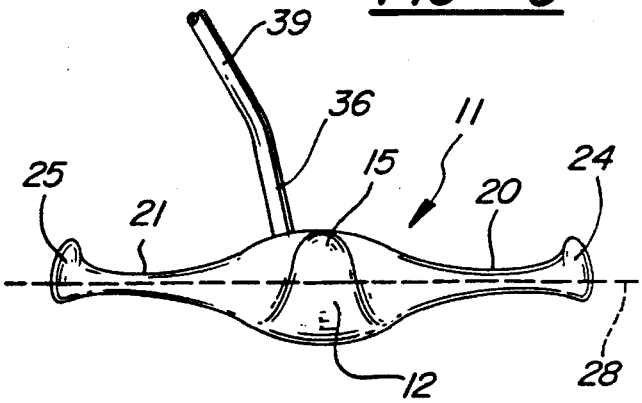
FIG - 7
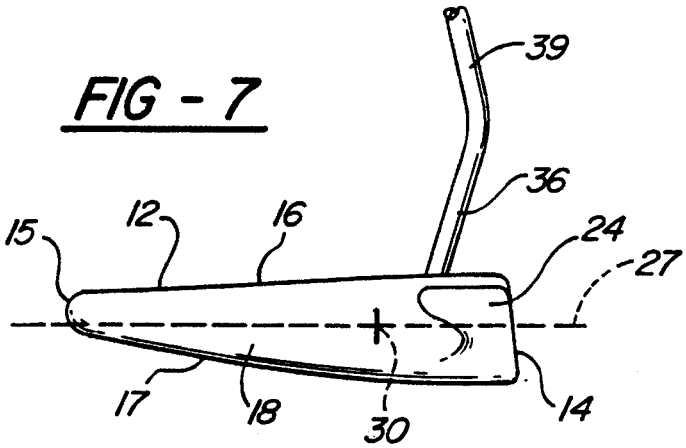

T-SHAPED GOLF PUTTER

BACKGROUND OF INVENTION

This invention relates to an improved golf club designed for putting. More specifically, it relates to a face-balanced putter which provides a stabilized swing, which impacts the ball in a way that produces a spin on the ball and which facilitates accurately aiming the movement of the ball in the desired direction.

Traditional golf putters are formed with a generally rectangularly formed head, one of whose broad, elongated surfaces provides the ball impacting surface, and a shaft extending upwardly from the head. The golfer grips a hand grip on the upper end of the shaft, and swings the club sufficiently to impact the head against the ball for moving the ball towards the hole at which the ball is aimed.

Putting properly takes considerable skill and practice to accurately move the ball to and into the hole. Very often, the golfer fails to precisely align the club head impact surface with the ball and, therefore, does not obtain his desired precise direction of movement of the ball. Precise movement of the club head relative to the ball and the hole is difficult to attain. Particularly, it is difficult for the golfer to align the head impact face with the hole, especially when the distance between the ball and the hole is long.

Even when a golfer practices putting, it may take a considerable number of times to properly grip and hold the club and swing it in the precisely desired direction to attain an accurate put. A typical putter does not have any means to guide the direction of the swing other than by visual approximation by the golfer.

Thus, there has been a need for a putter which provides a means for assisting the golfer to accurately aim the putter swing for practice purposes and also during actual playing of the golf game. In addition, there has been a need for a putter which is sufficiently stabilized during its swing so as not to twist or turn at an angle during the swinging movement, to help the golfer to obtain a precise swing in the aimed direction. The present invention relates to an improvement in a putter construction which greatly assists the golfer in aiming, swinging and impacting the ball both for practice purposes and for game purposes in order to improve the golfer's putting.

SUMMARY OF INVENTION

This invention contemplates a putter whose head is formed in a generally T-shaped configuration which is horizontally arranged. The leading edge surface of the cross-bar or head of the T-shape forms a generally vertically arranged ball-impacting surface. The stem of the T-shape is narrow and extends rearwardly of the cross-bar. The opposite arms forming the cross-bar or head of the T-shape extend laterally outwardly in a horizontal direction relative to the stem and terminate in enlargements. These enlargements form weights located on opposite sides of the stem and spaced a considerable distance from the central axis of the stem. Preferably, the lower surface of the stem is curved rearwardly and upwardly from the impact surface towards the free end of the stem so that when the head of the putter is swung on an arc to strike the ball, its lower surface moves along an arc to clear the ground.

The shaft or handle of the club joins the upper surface of the head at a point located rearwardly of the vertical impact face. The shaft extends for a short distance forwardly, and then upwardly at an angle to the vertical. The center of mass of the T-shaped head is located on the longitudinal axis of the stem of the head but rearwardly of the point where the shaft joins the head. Thus, when the club is swung by a golfer, gripping a conventional hand grip located on the upper end of the shaft, the vertically arranged forward impact surface strikes the ball while the center of mass of the head is still a few degrees rearwardly of, and is still swinging towards the vertical plane which contains the point that the club head ball impacting surface and the ball first make contact. The impacting contact, against the ball continues momentarily while the center of mass of the club head becomes aligned in a vertical plane at which time the impact surface is angled upwardly and rearwardly from its bottom to its top. This surface angularity results in the ball being given a slight spin just before separation of the ball from the impact surface of the head.

The arrangement of the weights which are integral with the free ends of the side arms of the T-shaped head stabilizes the movement of the head to substantially reduce any tendency for twisting or angular movement of the head relative to the direction that the club is aimed. This results in a very precise swing which accurately directs the head against the ball in the aimed direction.

Moreover, the invention contemplates providing indicia or markings along the stem and the arms of the head so that the swing may be accurately directed by visually aligning the elongated stem and the markings with the hole towards which the ball is aimed.

An object of this invention is to provide a simplified putter head construction which provides a stabilized swing that precludes angling or twisting of the impact head relative to the direction of the aiming of the ball and, in addition, assists the golfer in accurately aiming and swinging in the desired direction.

Further, it is an object of this invention to provide a putter construction which enables better control over the putter swing due to the location of the center of mass of the putter head, the arrangement of the impact surface of the head, and the configuration of the shaft. Because of these factors, when the ball is struck the impact with the putter head impact face tends to put a spin on the ball which will affect the direction and distance of travel of the ball.

Still another object of this invention is to provide a relatively inexpensive golf putter which may greatly improve the accuracy of the putting of a typical golfer and enable the golfer to practice precision swings, as well as to obtain precision swinging during putting in a game.

These and other objects and advantages of this invention will become apparent upon reading the following description, of which the attached drawings form a part.

DESCRIPTION OF DRAWINGS

FIG. 4 is a front elevational view of the putter.

FIG. 5 is an enlarged, front view, of the putter head and the lower portion of the shaft.

FIG. 6 is a rear view of the putter head and lower portion of the shaft.

FIG. 7 is a side elevational view of the putter head and the lower portion of the shaft.

DETAILED DESCRIPTION

Figure 1:
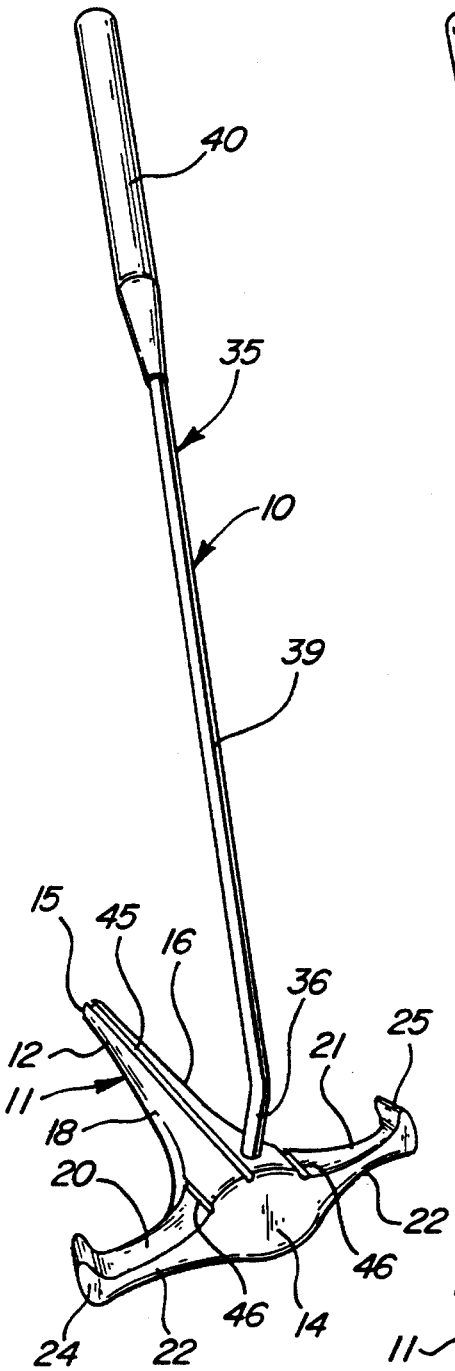
FIG. 1 is a perspective, front view of the golf putter.
Figure 2:
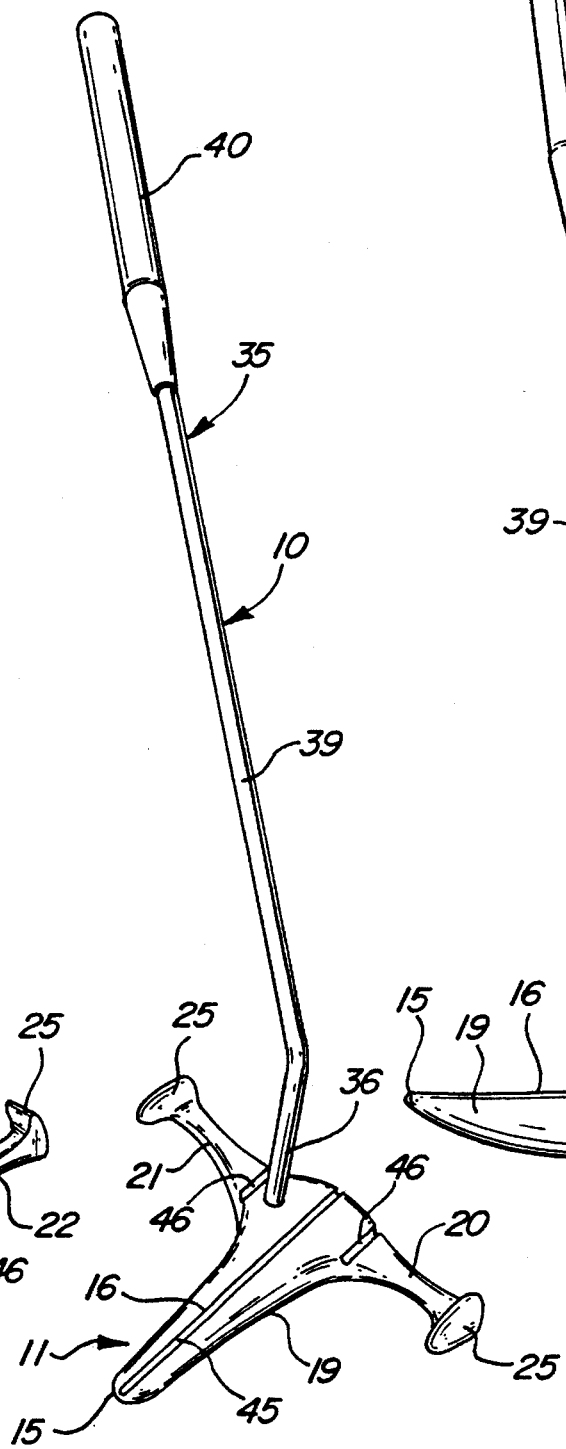
FIG. 2 is a perspective, rear view of the putter.
Figure 3:
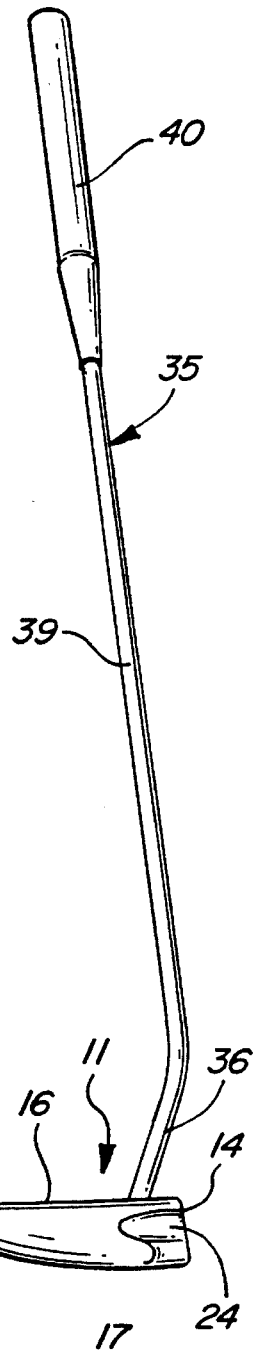
FIG. 3 is a side elevational view of the putter.

Referring to the drawings, the golf club 10, is provided with a roughly T-shaped head 11. The stem of the T-shape provides an elongated, narrow, main body portion 12 which is provided with a flat, impact face 14 on its forward end. The stem is generally tapered along its length to form a rearward tail portion 15 which is relatively pointed at its rear end. The stem has an upper surface 16, a curved lower surface 17 and side surfaces 18 and 19.

Figure 8:
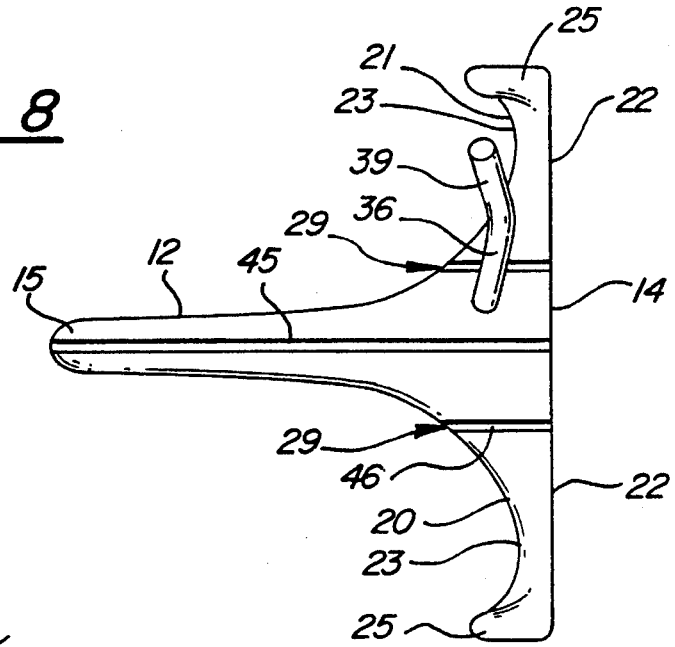
FIG. 8 is a top, plane view of the putter head and shows the lower portion of the shaft.

A pair of elongated, laterally extending arms 20 and 21 are joined to the opposite side surfaces 18 and 19 of the stem or body portion and form the cross-bar or head of the T-shape. The forward faces 22 of the arms are generally co-planar with the body portion face 14. As illustrated, the arms are narrow and preferably tapered in shape. Thus, the rear face 23 of the arms is tapered and is continuous with the tapered opposite side surfaces 18 and 19 such that an arc 29 is defined by each side surface and continuous rear surface as seen in FIG. 8.

The opposite ends of the arms terminate in integral enlargements 25 and 26 which form balancing weights on the opposite sides of the club head. As illustrated, these weights are spaced a considerable distance from the central axis 27 (shown in dotted lines in FIG. 7) of the stem or body portion.

Preferably, the tapered arms are angled slightly upwardly so that the weights are arranged just above the transverse axis 28 of the head. That is, preferably the weights are above the axis 28 which extends transversely of the stem in the horizontal plane (see dotted lines in FIGS. 5 and 6). The weights may be elongated so that they partially extend rearwardly of their junctures with their respective arms.

The elongation and shape of the stem or body portion result in the center of mass 30 of the head being located along the elongated or lengthwise central axis 27 at a distance rearwardly of the impacting surface 14 (see FIG. 7).

As is conventional, the club includes a shaft or handle 35 which is connected to and extends above the head. However, the shaft in this construction has a bent lower end portion 36 whose bottom end fits into a drilled socket 37 formed in the head. The shaft lower end is held in the socket by either a suitable adhesive or a friction fit or both.

The upper portion 39 of the shaft is angled relative to the lower end portion and is also angled relative to the head as illustrated in FIGS. 1–4. A conventional grip 40 is formed on the upper end of the shaft for holding and swinging the club.

To assist in aiming the swing of the club, an elongated, shallow groove 45, which may be colored with a suitable bright colored paint, forms a sighting line or mark on the upper surface of the stem or body portion. Preferably, the line extends from the impact face 14 to the rear end of the tail portion 15. In addition, similar side grooves, also colored with paint, form sighting lines or markings 46 along the areas where the arms are integrally connected to the stem of the head.

In operation, the golfer grips the shaft grip portion 40 and aligns the sight line 45, located on the upper surface of the stem, with the precise direction of movement intended when the ball is struck. The weights 25 and 26 stabilize the head and prevent unwanted angling or twisting of the head and its impact surface 14 during the swing of the golf club.

Figure 9:
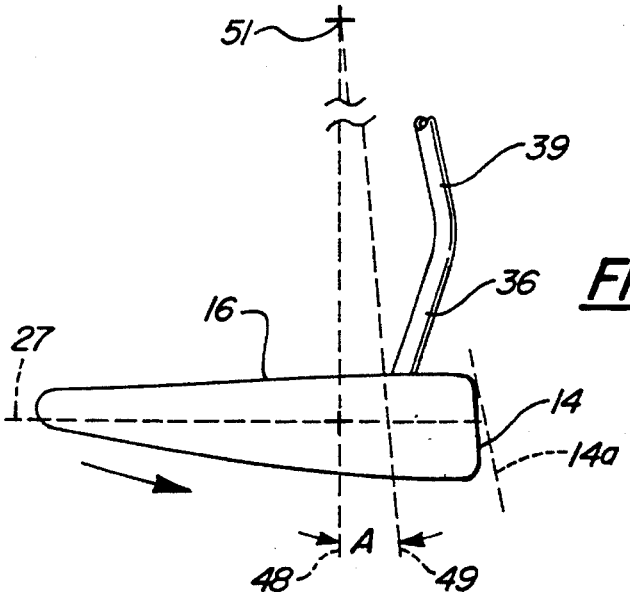
FIG. 9 is a schematic view illustrating the relationship between the center of mass of the head and the head impact surface and the shaft with the head moving towards the ball.
Figure 10:
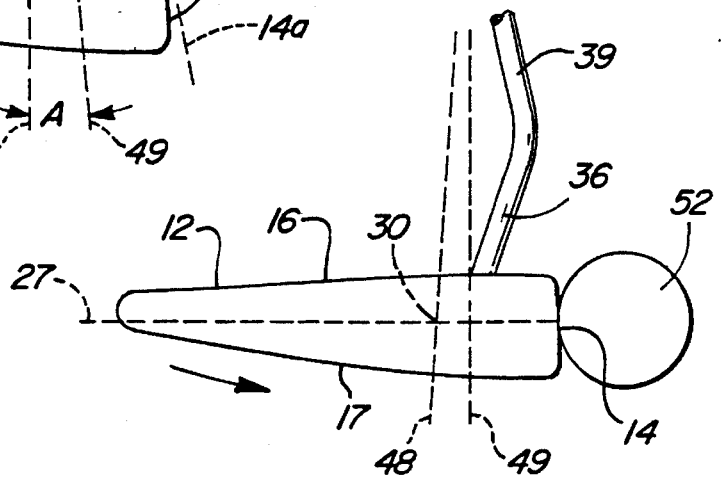
FIG. 10 is a schematic view showing the head making impacting contact with the ball, just prior to the alignment of the center of mass of the head with a vertical plane.
Figure 11:
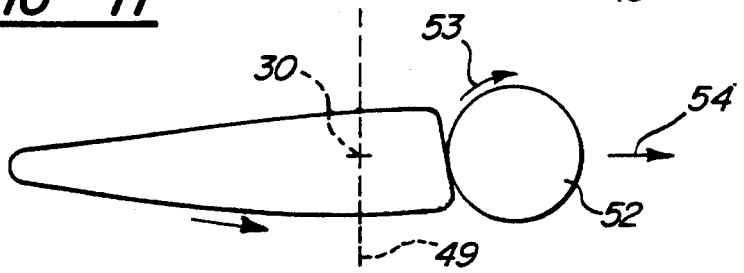
FIG. 11 schematically illustrates the completion of the impacting contact between the impact face of the head and the golf ball, showing the center of mass of the head arranged in the vertical plane.

As illustrated in FIG. 9, when the impact face 14 is vertical, during the swing, a plane or axis 48 containing the center of mass of the head is at a slight angle "A" relative to a vertical plane 49. The planes 48 and 49 converge at a center of swing 51. The effect of this arrangement and the movement of the head, relative to the ball is symbolized by the arrows in FIGS. 9, 10 and 11 of the drawings. Dotted line **14*a* indicates the impact face after contact with the ball. FIG. 9 shows the head swinging toward the ball 52. FIG. 10 shows the head impact surface 14 initially impacting against a ball 52. As the swing continues as shown in FIG. 11, the impact face 14 tilts slightly rearwardly relative to the vertical, such as on the order of about 2°, and the center of mass 30 approximately aligns with the vertical plane 49. The slight tilt or angularity of the face gives the ball a spin, as schematically symbolized by the arrow 53 and the directional movement arrow 54**.

The accuracy of the aim of the ball in the direction intended is assisted by the alignment of the markings, on the upper surface of the head, with the intended direction. The accuracy of the swing of the club is assisted by the stability of the movement of the head due to the widely spaced-apart weights. Moreover, since the movement of the head causes the impacting surface to be slightly tilted relative to the vertical, a spin is imparted to the ball. Further, the curved lower surface of the head enables the head to clear the ground surface, without rubbing against the ground, which might otherwise affect the swing.

This invention may be further developed within the scope of the following claims. Thus, the foregoing description is intended to be illustrative of an operative embodiment and not in a strictly limiting sense. Having fully described an operative embodiment of this invention, I now claim:

I claim:

1. A golf club having a head and a shaft connected to the head, comprising:

said head being formed in a generally T-shape including a narrow, normally horizontally arranged stem portion forming an elongated head body portion having a forward end forming a normally vertically arranged impact face, and with the body portion having an upper surface, a lower surface, and opposite side surfaces, said side surfaces being tapered away from the forward end;

said T-shape head including a pair of narrow, elongated, oppositely extending arm portions which extend laterally and horizontally from the opposite side surfaces of the stem and said arm portions include a forward surface co-planar with said impact face and are narrow and include a tapered rear face and angled slightly upward, and said tapered rear faces are continuous with said tapered opposite side surfaces such that an arc is defined by each side surface and continuous rear surface;

the free end of each of said arms terminate in an integral enlargement which provides a weight on the opposite-sides of and spaced from said body portion, said enlargements being located above a transverse plane extending through a central, longitudinal axis of said head body portion;

said shaft extending upwardly from the upper surface of said body portion and being connected to the body portion near, but spaced a short distance rearwardly, of the impact face of said body portion.

2. A golf club as defined in claim 1 above, and including said body portion having a center of mass that is located slightly rearwardly of the connection between the shaft and the body portion and located substantially on the longitudinal axis of said body portion.

3. A golf club as defined in claim 2 above, and including said shaft having a lower section connected to the body portion and extending upwardly from the upper surface of the body portion at an acute angle to the longitudinal axis of the body portion and, also, relative to the face of the body portion; said shaft lower portion being integral with a considerably longer upper shaft portion which is arranged at an acute angle relative to the lower portion and also at an acute angle relative to the vertical axis of the head body portion.

4. A golf club as defined in claim 3 above, and including the shaft lower portion being joined to the head at a location forwardly, that is, in the direction towards the body portion face, of the center of mass of the body portion.

5. A golf club as defined in claim 4 above, and including at least one visible sight line formed along the upper surface of the body portion and parallel to the longitudinal axis of the body portion for providing a sight-aiming line for the golfer.

6. A golf club as defined in claim 1 and including said body portion having a center of mass that is located slightly rearwardly of the connection between the shaft and the body portion and located substantially on the longitudinal axis of said body portion, and the shaft lower portion being joined to the head at a location between the body portion face and the center of mass of the body portion.

7. A golf club as defined in claim 6 and including said shaft having an integral lower section connected to the body portion and extending upwardly from the upper surface of the body portion at an acute angle relative to the longitudinal axis of the body portion and, also at an acute angle relative to the face of the body portion; said shaft lower section being integral with a considerably longer upper shaft section which is arranged at an acute angle relative to the shaft lower section and also relative to the vertical axis of the head body portion.

* * * * *